United States Patent [19]

Docherty et al.

[11] 4,325,457

[45] Apr. 20, 1982

[54] ACOUSTICAL BARRIER

[75] Inventors: William G. Docherty, Windsor; Alys J. Stegmaier, Dundas, both of Canada

[73] Assignee: Durisol Materials Limited, Mitchell, Canada

[21] Appl. No.: 93,420

[22] Filed: Nov. 13, 1979

[30] Foreign Application Priority Data

Jul. 19, 1979 [CA] Canada ..... 332118

[51] Int. Cl.[3] ..... E04B 1/82; E04H 17/00; C04B 43/00

[52] U.S. Cl. ..... 181/210; 181/294

[58] Field of Search ..... 181/210, 284–294; 428/310, 539; 52/595, 593, 630, 782

[56] References Cited

U.S. PATENT DOCUMENTS

| | | | |
|---|---|---|---|
| 1,230,381 | 6/1917 | Comerma . | |
| 2,877,532 | 3/1959 | Heine . | |
| 3,063,202 | 11/1962 | Carper | 52/595 |
| 3,283,849 | 11/1966 | Schirick et al. . | |
| 3,393,261 | 7/1968 | Herzig et al. . | |
| 3,440,784 | 4/1969 | Onjukka | 52/595 |
| 3,607,605 | 9/1971 | Suzukawa | 428/310 HC |
| 3,625,808 | 12/1971 | Martin | 52/595 |
| 3,656,576 | 4/1972 | Qubela | 181/210 |
| 3,867,995 | 2/1975 | Sanders | 181/285 |
| 3,919,444 | 11/1975 | Shayman . | |
| 4,100,710 | 7/1978 | Kowallik | 52/595 |
| 4,133,928 | 1/1979 | Riley et al. | 428/310 HC |

FOREIGN PATENT DOCUMENTS

| | | | |
|---|---|---|---|
| 2800529 | 7/1979 | Fed. Rep. of Germany | 181/210 |

*Primary Examiner*—George H. Miller, Jr.
*Assistant Examiner*—Benjamin R. Fuller
*Attorney, Agent, or Firm*—David M. Ostfeld

[57] ABSTRACT

The invention is a new acoustic panel and sound barrier constructed therefrom in which the panel is composed of a layer of fine aggregate concrete and a layer of chemically mineralized and neutralized fibres blended with portland cement. The panel may have a tongue and groove to form airtight joints. The barrier is effective, fire proof, weather resistant, corrosion resistant and not adversely affected by chemical herbicides.

4 Claims, 5 Drawing Figures

ACOUSTICAL BARRIER

BACKGROUND OF THE INVENTION

This invention relates to sound barriers or sound attenuating walls, which may be erected outdoors. Panels used for sound barriers may reflect and/or absorb sound and are useful for protection from highway, railroad and industrial noise. Sound-insulating walls are, with increasing frequency, being built to protect residential areas from such excessive noise sources.

SUMMARY OF THE INVENTION

According to one aspect of the invention there is provided an acoustic panel with a first layer and a second layer joined as two laminae, said first layer comprising mineralized fibrous material blended with cement and said second layer comprising a fine aggregate concrete.

According to a second aspect the invention is a sound barrier comprising a plurality of said acoustic panels wherein the panels are arranged in courses and affixed to support columns so that the barrier is substantially airtight.

Sound insulation may be provided by merely providing a barrier in which case a dense material is preferable or by attempting to attenuate the sound by absorption in which case less dense and porous material is preferable. In practical terms neither technique alone provides the best result. A desirable approach then is to include these two types of materials in combination. Accordingly in the present invention the sound absorptive material is made of chemically mineralized fibrous material blended with cement and formed into a panel shape. For example the material could comprise chemically mineralized and neutralized softwood or hardwood shavings blended with portland cement. Vegetable or textile fibres for example sugarcane (bagasse), coco fibres, parts of palms, various grasses, cereal plants, plant fibres, reed, papyrus and other sedges, lofas and similar vegetable material as well as inorganic fibres and aggregates for example asbestos, glass wool, rock wool and vermiculite could be used. Where organic material is used it must be mineralized and neutralized if noxious components exist which components may adversely affect the binding quality of the cement. Various binders may be used, whether organic or inorganic cements such as hydraulic cements, hydraulic limes, porous binders or other adhesives or glues. Such material is known by its trade mark DURISOL, a product of Durisol Materials Limited. The sound barrier material is a fine aggregate concrete applied to one surface of the DURISOL panel. The panels are designed to be of a convenient size and with a tongue and groove so that adjacent panels may interlock to form an air-tight and sound proof barrier. The panel provides a mass of approximately 20 pounds per square foot and a panel 10 cm. thick has a noise reduction coefficient of 0.72.

The DURISOL material itself is an open textured product, highly durable, rated practically incombustable, vermin proof and does not rot or decay. Its density is relatively low for a building material (30 to 35 pounds per cubic foot) and yet it has relatively high strength. Tests show that the material is freezethaw resistant and has negligable capillary suction because the material has an irregular open cell structure with pore sizes larger than capillary pore dimensions. Also the material is dimensionally stable having a coefficient of thermal expansion of approximately 0.000008 in./in./°F. Volume change due to a variation in moisture content is less than 0.5%. In addition, the material is workable with standard carpenters tools and the material provides an ideal surface for carrying plaster or stucco coatings.

Panels made according to the present invention have many advantages. The components of the sound barrier are fireproof and corrosion resistant, capable of withstanding exposure to the natural elements of the weather and to road de-icing chemicals and fungicides. Furthermore, the panels are durable and are not sensitive to wind-blown or wheel-thrown objects or objects discharged from snowclearing equipment. The DURISOL side of the panel faces the noise source and therefore the traffic side is without protruding parts, facilitating easy cleaning and furthermore it provides a nonglare surface.

There is no restriction on the height of the sound barrier. The columns and footings are selected to accommodate specific wall heights and furthermore adjacent sections of wall can be different heights. Noise reduction is assured because of the interlocking tongue-and-groove joint panels, the grouted seals between panels and posts and back filling against the lower panels. Installation procedures are simple and posts and panels are replaceable. Changes in alignment, horizontal or vertical, are easily accommodated without creating gaps or necessitating nonstandard components.

BRIEF DESCRIPTION OF THE DRAWINGS

For the purpose of illustration, but not of limitation, embodiments of the invention will be hereinafter described, in which.

DETAILED DESCRIPTION OF THE PREFERRED EMBODIMENT

Figure 1:
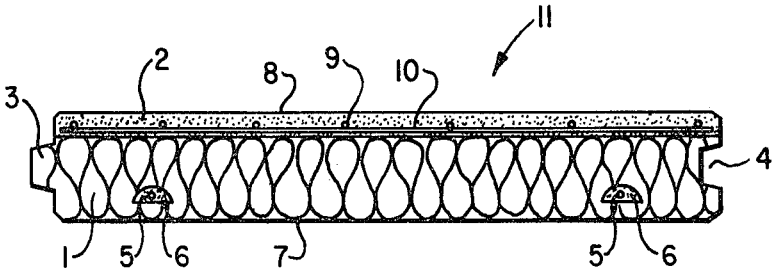
FIG. 1 shows one embodiment of the acoustic panels.

As shown in FIG. 1, a panel 11 according to one aspect of the present invention includes a first layer 1 comprising a material which may be made of chemically mineralized and neutralized softwood shavings blended with portland cement and a second layer 2 comprising a fine aggregate concrete. As noted earlier, the material in the first layer 1 is known by its trade mark DURISOL and, for convenience, will be referred to by its trade mark in this specification. A typical panel may have a surface 10 feet by 20 inches and a thickness of about 80 mm. A tongue 3 and a corresponding groove 4 extend along the top and bottom edges respectively of the panel. The tongue and groove provide an air-tight joint between adjacent interlocking panels. Since the tongue is on the upper edge of a lower panel and the groove is on the lower edge of an adjacent upper panel, water does not accumulate in the joint. The edges of the panel may be chamfered as shown in FIG. 1.

A first reinforcing means, for example a reinforcing bar 5 of suitable gauge, encased in mortar 6, extends the length of the panel and may be positioned closer to the exposed or first surface 7 in the first layer 1. In FIG. 1, two of such mortar encased reinforcing bars are shown.

Of course the cross-sectional shape of the panel could be modified. For example the reinforcing bar 5 could be located even closer to the tongue and groove edges, the panel being thicker at these points and perhaps thinner in the central region.

Embedded in the second layer 2 is a second reinforcing means, for example reinforcing wire 9,10 which extends horizontally and vertically, respectively. Of course other reinforcing materials and arrangements may be employed.

Figure 4:
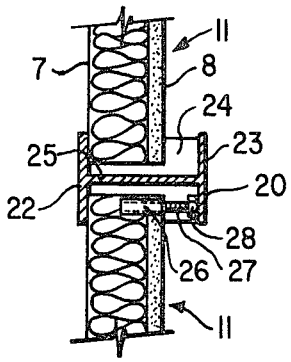
FIG. 4 is a sectional view along line 4—4 in FIG. 3.

The first layer 1 composed of DURISOL may have two portions. A first portion adjacent the first surface 7 and about 1.5–2.0 mm thick extends up the longitudinal edges of the panel so as to form the tongue 3 and groove 4. The DURISOL in this portion may have a higher cement content, for example an increase of 15%. This portion may also include suitable pigment for the manufacture of coloured panels. The second portion occupies the balance of the first layer and is composed of ordinary DURISOL. The second layer 2 is composed of high quality mortar and may be compacted into place by a vibrating screed. An internally threaded insert 26 (as shown in FIG. 4) may be placed at the center line in each end of the second surface of the panel. The purpose of the insert will be described later.

The first layer 1 acts as a sound-attenuating panel because it absorbs sound. The second layer 2 is more dense and acts as a barrier to the transmission of sound. The first surface 7 faces the source of noise, for example a highway, while the second surface 8 faces away from the noise source for example, a neighbourhood. Of course, the construction of the panel could be varied so that the first layer 1 is on both sides of the second layer 2. A barrier constructed from such panels would also tend to absorb rather than reflect noise from the "quite" side as well as reduce the transmission of sound because of the central second layer layer 2.

Figure 2:
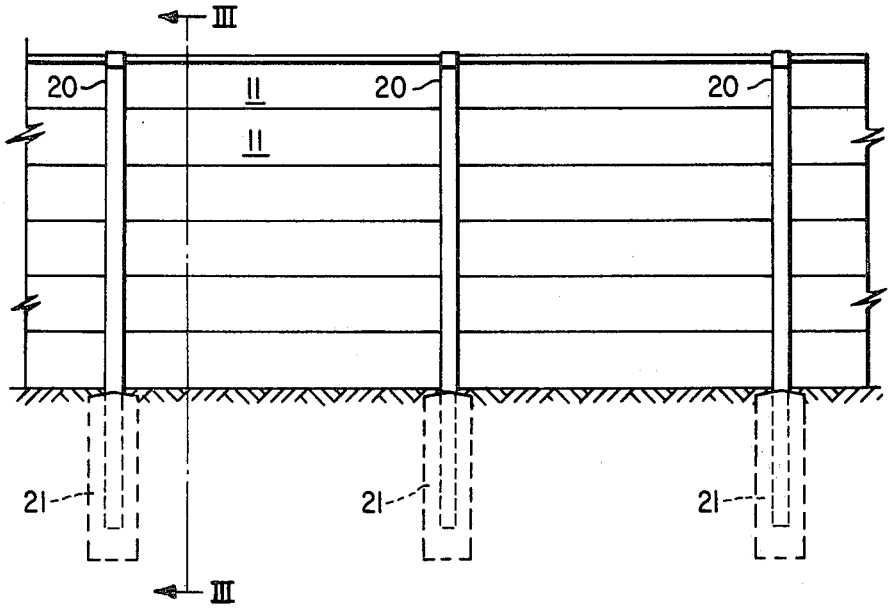
FIG. 2 is an elevation view of the acoustic barrier according to the present invention.
Figure 3:
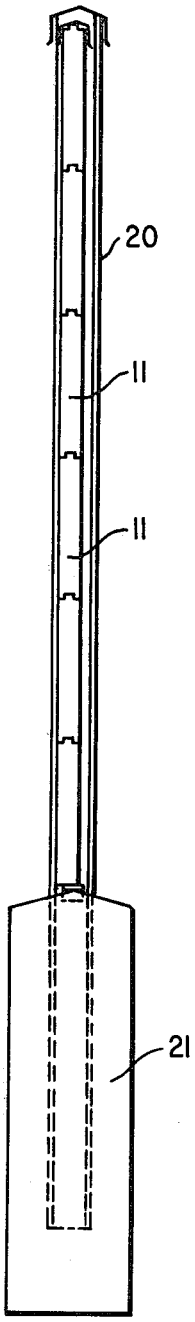
FIG. 3 is a sectional view along line 3—3 in FIG. 2.

FIGS. 2 and 3 show one example sound barrier constructed from panels according to the invention. Support columns 20 are placed in concrete footings 21 at predetermined distances. The support column 20 may be of any suitable cross-sectional shape, for example a wide-flange beam or paired channels or paired box sections. A wide-flange section is shown in FIG. 4. The columns must be able to withstand all wind loads to which the barrier is subjected. The panels 11 are arranged in horizontal courses with each tongue facing upwardly and adjacent panels joined tightly together so as to prevent noise transmission through the joint. The uppermost panel may have a transversely inclined upper edge instead of a tongue. This upper edge may be a continuation of the second layer 2 being constructed of cement, the inclination allowing water to drain from the top edge towards the second surface 8. Alternatively, the uppermost panel may be an ordinary panel with a tongue on the upper edge, in which case a flashing could be installed over the upper edge. Similarly, a cap may cover the top of each column to prevent water from entering the joints between the panels and the supporting column.

One example of a joint between the panels and the column can be seen in FIG. 4. The panels are placed from above in the open sides of the "H" structure of adjacent columns so that the first surface 7 is towards the flange 22 and the second surface 8 is thus spaced from the opposite flange 23. A sealing means 24 being grout filler or plyable seal material fills the space between the ends of the panels and the web 25 as well as the space between the flange 23 and the second surface 8 of that portion of the panel within the column. Thus the joint between the panels and the column is also air-tight.

An insert 26 may be placed in the end of the panel at the time it is manufactured, the insert having internal threads to receive a bolt 27. The bolt 27 is screwed out from the insert 26 until the head 28 presses against the inside of the flange of the column, thus forcing the panel against the opposite flange.

Figure 5:
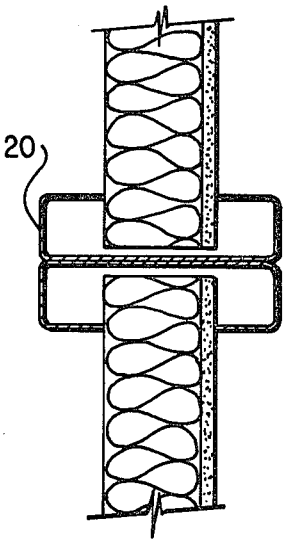
FIG. 5 shows a second type of column support.

Alternatively, the panels could be placed against the outside face of the flange on the column and supported by a suitable bracket fastened to the column. Similarly, as seen in FIG. 5, the column 20 could comprise two hollow sections joined back-to-back and adapted to receive the panel.

After the barrier is erected, the earth is back-filled against the lower panels so as to seal the space between adjacent support columns.

What we claim as our invention is:

1. An acoustic panel for use as an external wall acoustical attenuator for sound sources, comprising:

a set of panels, each of said panels including a first layer and a second layer joined as two laminae, said first layer including mineralized fibrous material blended with cement and said second layer including a fine aggregate concrete, wherein a first reinforcing means is located within said first layer, said first reinforcing means comprising reinforcing steel encased in mortar and extending throughout the length of the said panel;

support columns having means for supporting said panels and withstanding wind loads to which said panels are subjected and maintaining the acoustical panel airtight;

each of said panels being oriented with said first layer facing the source of the sound.

2. An acoustic panel as defined in claim 1 wherein said cement is portland cement and the said first layer includes a first portion which includes an increased portland cement content of approximately 15% the said first portion being about 1.5 to 2.0 mm. thick from its exposed surface.

3. A sound barrier comprising a plurality of acoustic panels, each panel having a first layer and a second layer joined as two laminae, said first layer comprising mineralized partially or totally inorganic fibrous material blended with cement and said second layer comprising a fine aggregate concrete, wherein said panels are arranged in courses and affixed to support columns, which are supported in the ground, and a sealing means to provide a seal between the ends of the panels and the support column, so that the barrier is substantially airtight.

4. An acoustical panel with a first layer and a second layer joined as two laminae, said first layer comprising mineralized partially or totally inorganic fibrous material blended with cement and said second layer comprising a fine aggregate concrete, wherein a first reinforcing means is located within said first layer, said first reinforcing means comprising reinforcing steel encased in mortar and extending throughout the length of the said panel.

* * * * *

UNITED STATES PATENT AND TRADEMARK OFFICE

CERTIFICATE OF CORRECTION

PATENT NO. : 4,325,457

DATED : APRIL 20, 1982

INVENTOR(S) : WILLIAM G. DOCHERTY, ALYS J. STEGMAIER

It is certified that error appears in the above—identified patent and that said Letters Patent is hereby corrected as shown below:

Column 3, line 35: change "'quite'" to -- "quiet" --.

Signed and Sealed this

*Thirteenth* Day of *July 1982*

[SEAL]

*Attest:*

GERALD J. MOSSINGHOFF

*Attesting Officer*

*Commissioner of Patents and Trademarks*